United States Patent [19]

Girard et al.

[11] Patent Number: 4,899,881

[45] Date of Patent: Feb. 13, 1990

[54] SIMULATED FOOD PRODUCT CARRIER

[76] Inventors: Leland K. Girard, 693 Madelyn Dr., Des Plaines, Ill. 60016; Robert L. Hinchcliffe, 715 Daventry Dr., Baton Rouge, La. 70808

[21] Appl. No.: 92,406

[22] Filed: Sep. 2, 1987

[51] Int. Cl.[4] ..... B61D 73/00

[52] U.S. Cl. ..... 206/457; 206/45.31; 206/557

[58] Field of Search ..... 206/457, 45.31, 557

[56] References Cited

U.S. PATENT DOCUMENTS

| | | | |
|---|---|---|---|
| 2,076,140 | 4/1937 | Faunce | 206/457 |
| 2,085,951 | 7/1937 | Carter et al. | 206/457 |
| 2,666,710 | 1/1954 | Peters | 206/457 |
| 4,483,629 | 6/1984 | Goldberg | 206/457 |
| 4,485,921 | 12/1984 | Geller | 206/457 |
| 4,494,654 | 1/1985 | Gunther et al. | 206/45.31 |
| 4,653,642 | 3/1987 | Hakun et al. | 206/457 |
| 4,676,371 | 6/1987 | Byrne | 206/45.34 |
| 4,697,718 | 10/1987 | Butcher et al. | 206/45.34 |

*Primary Examiner*—Joseph Man-Fu Moy
*Attorney, Agent, or Firm*—Wood, Dalton, Phillips Mason & Rowe

[57] ABSTRACT

A simulated food product carrier formed of synthetic resin accurately conforming to a carrier portion of an actual foodstuff, such as an oyster half shell. The simulated food product representation is formed as a printing on a suitable nontoxic synthetic resin cover sheet, permitting the food product to be stored and served thereon. In one embodiment, the carrier is formed of high temperature resistant synthetic resin, permitting the carrier and food product thereon to be heated for serving. The carrier is adapted for extended storage at freezing temperatures. The carrier is provided, in one form, as individual food product carriers and, in another disclosed form, as a portion of a serving tray or dish.

31 Claims, 3 Drawing Sheets

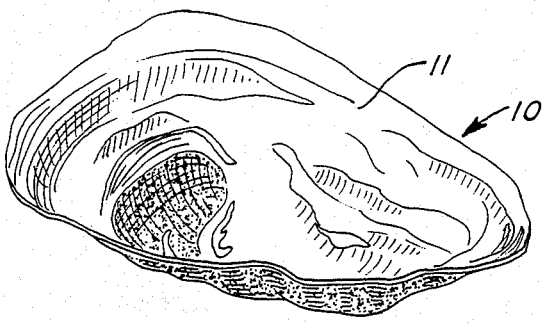
FIG. 1
FIG. 2
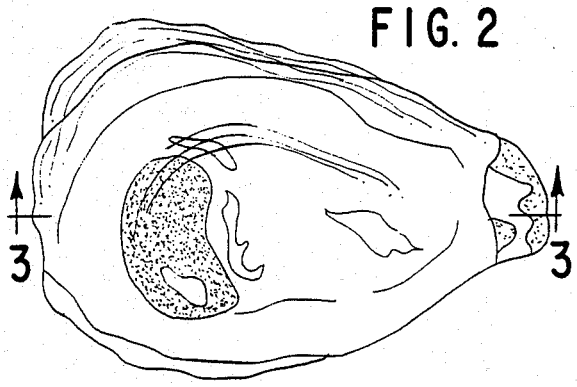
FIG. 5
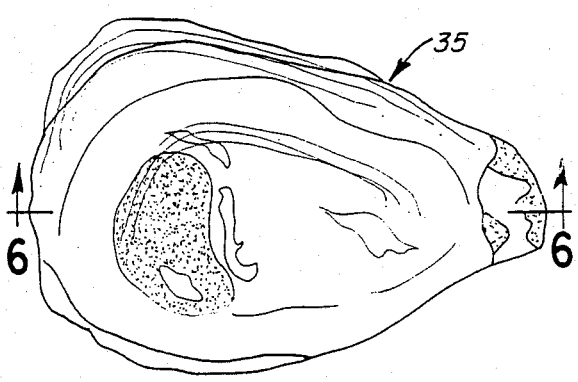
FIG. 3
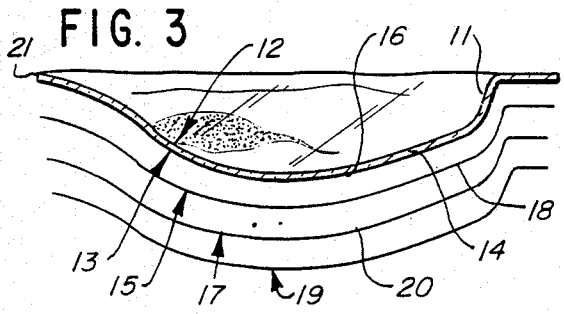
FIG. 6
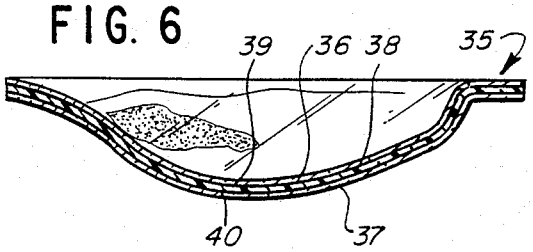
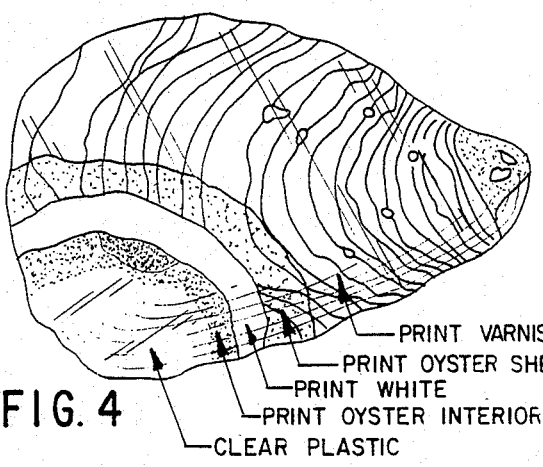
FIG. 4
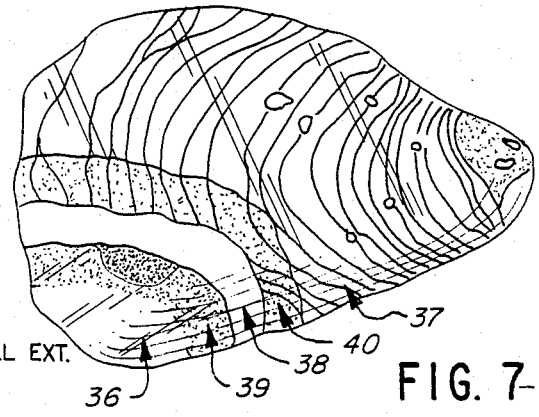
FIG. 7

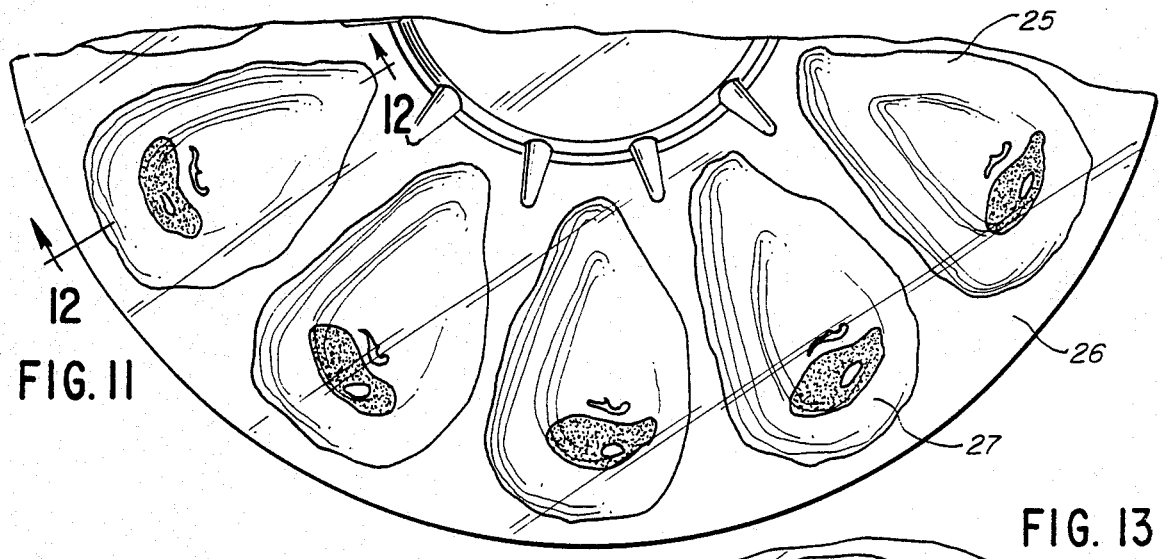
FIG. 11
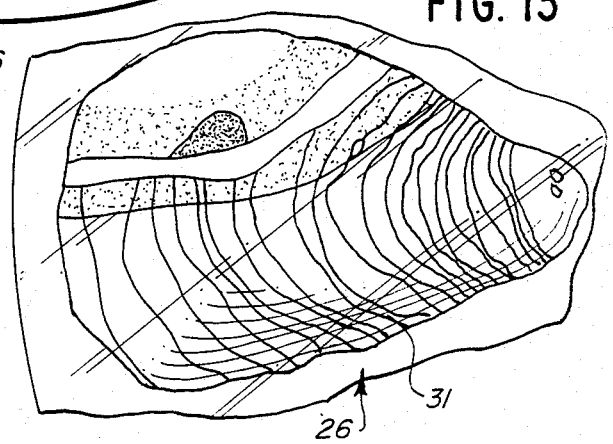
FIG. 13
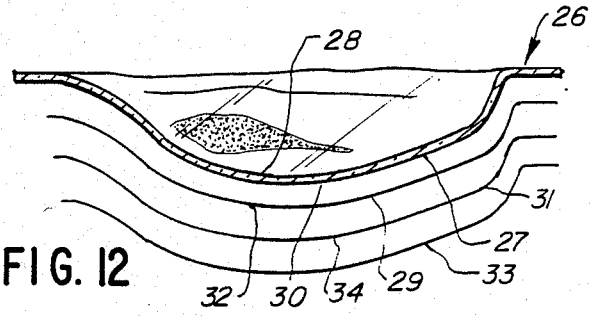
FIG. 12
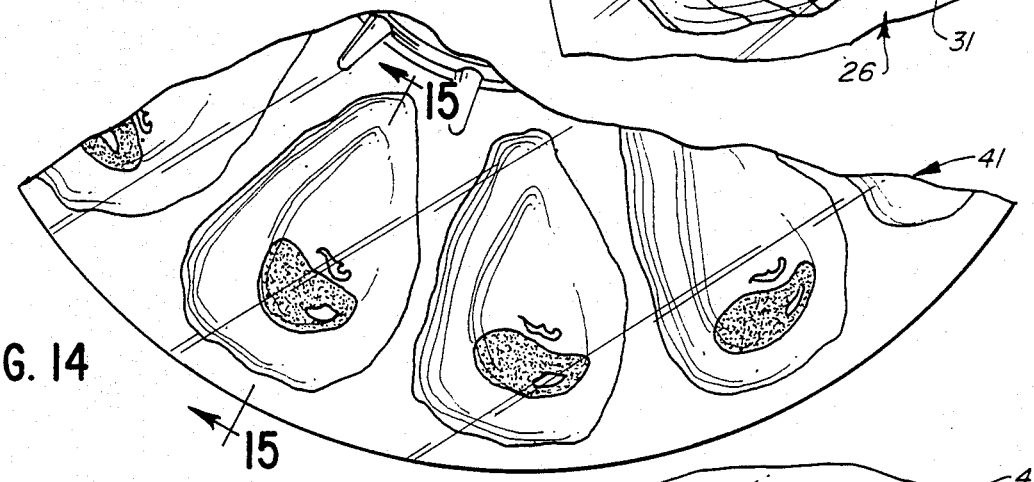
FIG. 14
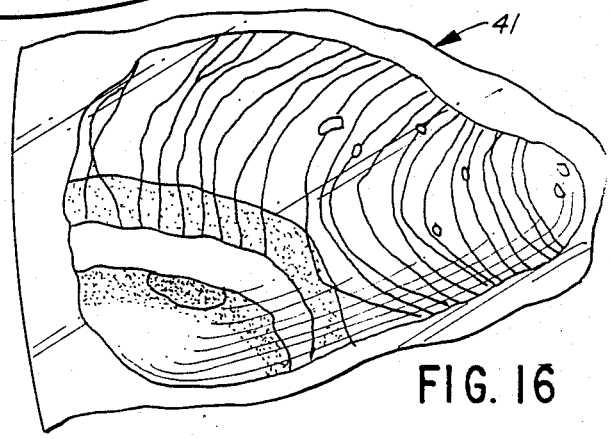
FIG. 16
FIG. 15
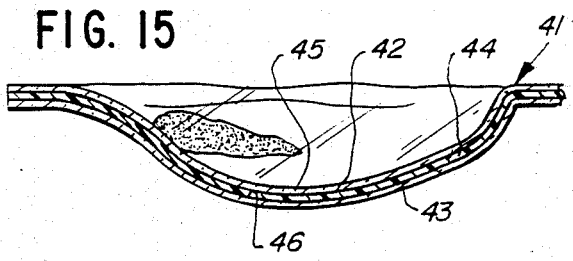

SIMULATED FOOD PRODUCT CARRIER

TECHNICAL FIELD

This invention relates to food product carriers and in particular to food product carriers adapted for consumption of food products therefrom by humans.

BACKGROUND ART

Certain foodstuffs have conventionally been served for consumption by humans in an outer portion of the foodstuff as it occurs in nature. Thus, illustratively, melon balls have been served in scooped out melons. Shellfish, such as oysters and clams, have conventionally been served in their shells.

Prepared foodstuffs, such as Oysters Rockefeller, may similarly be served in oyster shells.

It has further been conventional to provide serving dishes, such as serving bowls or platters, in the form of simulated foodstuffs. Thus, it has been conventional to provide bowls in the form of pumpkins, platters in the form of fish, etc.

Where the food product is served in a portion of its original outer container, such as where oysters are served in the half shell, a problem arises in that it is difficult to maintain the food product fresh for any period of time in the container. Thus, it has been conventional to shuck oysters at the time they are being served on the half shell. Similar time constraints exist relative to other food products of this type.

There has been a longfelt need for means for storing such food products, as with conventional refrigeration or freezing means, permitting their facilitated preparation for consumption when desired.

DISCLOSURE OF INVENTION

The present invention comprehends an improved food product carrier which simulates the outer portion of a food product and which permits the facilitated storage and ready arrangement for consumption of the food product carried thereby.

More specifically, the invention comprehends the provision of a simulated food product carrier including a transparent wall element formed of a synthetic resin adapted to support edible foodstuffs without adverse physiological effect on one eating such supported foodstuffs, the wall element defining a rear surface, a first representation of a front surface of a food product carrier on the rear surface to be viewable through the wall element an opaque layer overlying the representation, and a second representation of a rear surface of the food product carrier overlying the opaque layer to be viewable from rearwardly of the wall element.

In the illustrated embodiment, the food product carrier comprises a simulated oyster shell.

The invention comprehends that the wall element be formed of a synthetic resin capable of storage at subfreezing temperatures.

The invention further comprehends that the wall element be formed of a synthetic resin capable of being heated to over 300° F. without deformation thereof.

The invention comprehends the provision of the wall elements to have a preselected three-dimensional configuration.

The wall element, in one form, comprises a support defining a plurality of portions each defining an individual simulated food product carrier.

A protective coating may be provided on the second representation.

In a modified form, the opaque layer comprises an opaque second wall element underlying the first representation. A transparent third wall element underlies the second wall element, and the second representation of the rear surface of the food product carrier is disposed on the front surface of the transparent third wall element.

The opaque wall element, in the illustrated embodiment, is formed of a carbamide synthetic resin.

In another embodiment, the simulated food product carrier includes a transparent first wall element formed of a synthetic resin adapted to support edible foodstuffs without adverse physiological effect on one eating such supported foodstuffs, the wall element defining a rear surface, a first representation of a front surface of a food product carrier on the rear surface to be viewable through the first wall element, a transparent second wall element having a rear surface facially juxtaposed to the rear surface of the first wall element, and a second representation of a rear surface of the food product carrier on the rear surface of the second wall element to be viewable through the second wall element.

The carrier is formed to have a preselected three-dimensional configuration and, in the illustrated embodiment, defines an upwardly opening cavity for carrying the foodstuff.

Means are provided for precluding viewability of the second representation through the first wall element and precluding viewability of the first representation through the second wall element.

In yet another embodiment, the simulated food product carrier includes a transparent wall element formed of a synthetic resin adapted to support edible foodstuffs without adverse physiological effect on one eating such supported foodstuffs, the wall element defining a tray having a rear surface, a plurality of first representations of a front surface of a food product on the rear surface to be viewable through said wall element, an opaque layer overlying the representations, and a corresponding plurality of second representations of a rear surface of the food product carrier underlying the opaque layer and aligned with the first representations.

The wall element is formed to define three-dimensional food carrier configurations at each of the aligned representations on the tray.

In the illustrated embodiment, the three-dimensional configurations define upwardly opening cavities.

In the illustrated embodiment, a protective coating is provided on the second representation on the tray.

Thus, the invention broadly comprehends the provision of individual simulated food product carriers, as well as food product carriers forming discrete portions of a tray or the like. The carriers are formed of material suitable for the desired storage conditions and for permitting the foodstuffs carried thereby to be heated when required. The simulated food product carrier construction of the present invention is extremely simple and economical, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a food product carrier embodying the invention;

FIG. 2 is a plan view thereof;

FIG. 3 is an exploded vertical section taken substantially along the line 3—3 of FIG. 2;

FIG. 4 is a bottom plan view thereof;

FIG. 5 is a plan view of a modified form of food product carrier embodying the invention;

FIG. 6 is a vertical section taken substantially along the line 6—6 of FIG. 5;

FIG. 7 is a bottom plan view of the food carrier product of FIG. 5;

FIG. 11 is a fragmentary top plan view of a modified form of tray embodying the invention having simulated food product carrier portions integral therewith;

FIG. 12 is a vertical section taken substantially along the line 12—12 of FIG. 11;

FIG. 13 is a fragmentary bottom plan view of the tray of FIG. 11 illustrating the bottom representation of a food product carrier therein;

FIG. 14 is a fragmentary top plan view of a modified form of tray having simulated food product carrier portions formed therein;

FIG. 15 is a vertical section taken substantially along the line 15—15 of FIG. 14; and FIG. 16 is a fragmentary bottom plan view of the tray of FIG. 14 illustrating the bottom representation of one of the food carrier portions thereof.

BEST MODE FOR CARRYING OUT THE INVENTION

Figure 8:
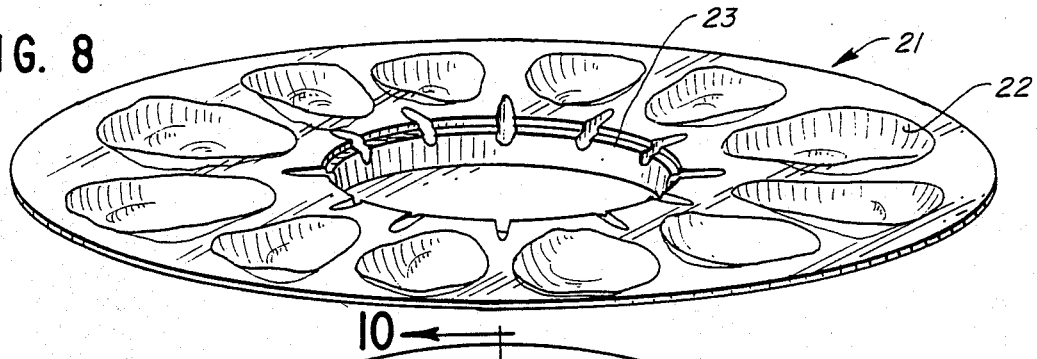
FIG. 8 is a perspective view of a tray provided with a plurality of simulated food product carriers embodying the invention.

In the illustrative embodiment of the invention as disclosed in the drawing, a simulated food product carrier generally designated 10 comprises a simulated oyster shell. The simulated oyster shell, as shown, defines an upwardly opening cavity 11 adapted to receive a raw oyster so that when the combination is served, it simulates a conventional oyster on the half shell serving.

The invention comprehends that the simulated food product carrier be formed of suitable synthetic resin so as to permit its use in connection with the storage, heating, and serving of such food products. More specifically, the invention comprehends that the top layer of the simulated food product carrier, generally designated 12, be formed of a suitable synthetic resin adapted to carry the edible foodstuff without adverse physiological effect on one eating the supported foodstuff therefrom.

In the illustrated embodiment as best seen in FIG. 3, the upper layer sheet 12 comprises a clear sheet of synthetic resin. A representation 13 of the inner surface of the oyster shell is applied to the underside 14 of the sheet 12. An opaque white layer 15 is applied to the underside 16 of the representation 13.

A representation 17 of the underside, or exterior, of the oyster shell is provided on the lower surface 18 of the opaque layer 15.

A layer 19 of clear varnish is applied to the underside 20 of the outer representation 17.

The representation layers and opaque layer may be applied successively to the underside of the top layer sheet by conventional printing processes, with the top sheet in planar form. Upon completion of the printing of the sheet with the indicated layers, the layered structure is formed three-dimensionally by suitable press-forming to define the upwardly opening cavity 11. The completed food product carrier may be cut from the planar sheet along the peripheral edge 21 to complete the formation of the individual simulated food product carrier.

Illustratively, the upper synthetic resin sheet is formed of a transparent resin adapted to support edible foodstuffs and the like without adverse physiological effect on one eating such support foodstuffs therefrom. One such synthetic resin approved by the Federal Drug Administration for such use is a copolyester resin comprising noncrystalline polyethylene-terephthalate resin. In the illustrated embodiment, the upper sheet 12 has a thickness of approximately 0.020". As will be obvious to those skilled in the art, any suitable thickness may be utilized as desired.

One excellent example of a commercial copolyester resin of this type is that manufactured by Eastman Chemical Company under the brand designation KODAR 6763.

The printing of the different representations may be effected by means of conventional lithographic of silk screening processes. The printing inks preferably comprise nontoxic inks.

As will be obvious to those skilled in the art, the upper representation and lower representation may be effectively made opaque so as to obviate the need for the opaque layer 15. Where the opaque layer is used, it is preferably printed of white, nontoxic ink.

As indicated above, a surface coating of varnish or other approved coating materials may be utilized on the bottom surface of the carrier 10 and may be applied thereto by conventional lithographic or roll coating methods, as desired.

As will further be obvious to those skilled in the art, the different representations and opaque layer may be provided on separate thin plastic sheets, with the carrier then comprising a laminate of the sheets. Thus, for example, the upper and lower representations may be provided on opposite surfaces of an opaque sheet laminated to the under surface 14 of the top sheet 12.

As will further be obvious to those skilled in the art, the opaque sheet may be of any suitable color for the desired carrier. Thus, while the opaque sheet has been characterized above as a white opaque sheet, it may comprise a black sheet, or colored sheet as desired, within the broad scope of the invention, commensurate with the representational requirements of the printed matter.

The three-dimensional configuration is imparted to the printed sheets by conventional methods, such as heating and vacuum-forming in a suitable mold (not shown). The mold may be provided with multiple cavities so as to permit the formation of a plurality of similar carriers in each molding operation.

The cutting of the individual carriers from the sheet may be effected by any conventional method, such as die cutting using a steel-ruled die or set of matched dies.

In use, a raw oyster is removed from its shell by a conventional shucking operation, and placed in the simulated food product carrier 10. As the food product carrier accurately corresponds to and has substantially identical appearance to an oyster shell, the combination of the shucked oyster and supporting carrier closely resemble a natural oyster on the half shell The thusly carried oysters may be stored for subsequent consumption. Illustratively, they may be maintained in a refrigerated space, such as that of a conventional home refrigerator where the storage period is relatively short. Alternatively, where it is desired to maintain the oysters stored for a longer period of time, they may be stored in the conventional freezer.

Figure 9:
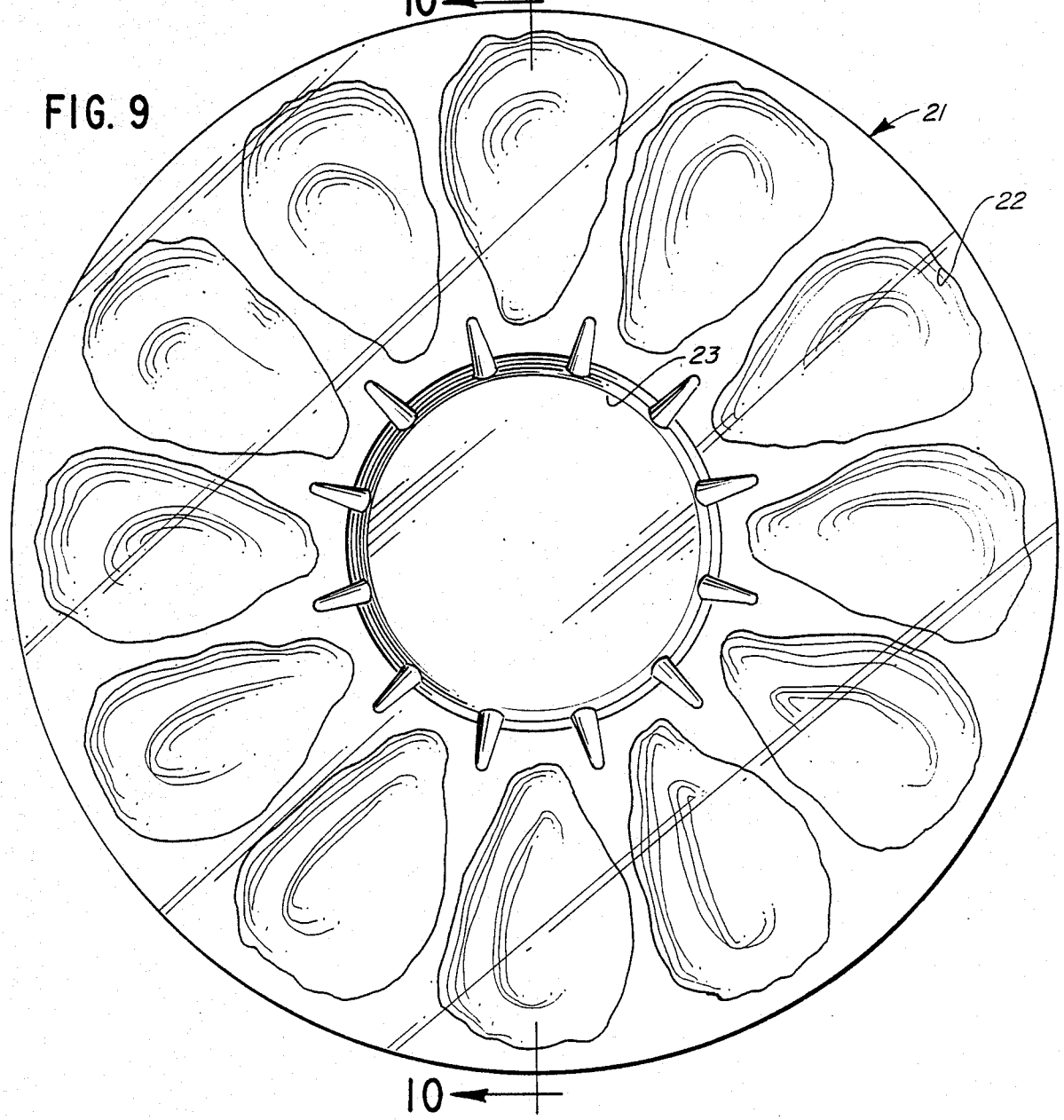
FIG. 9 is a top plan view of the tray of FIG. 8.
Figure 10:
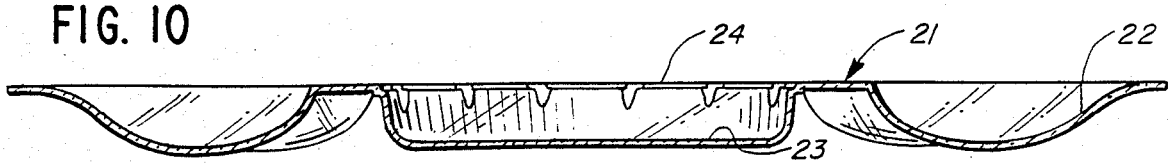
FIG. 10 is a reduced vertical section taken substantially along the line 10—10 of FIG. 9.

Conventionally, oysters on the half shell are served in quantities of one-half dozen or one dozen. The invention comprehends the storage of the oysters so carried on the simulated food product carriers 10 on a suitable tray, such as illustrated in FIGS. 8–10, where a dozen such oysters may be provided. As shown in the drawing, the tray 21 is provided with a plurality of upwardly opening recesses 22, each adapted to receive one of the simulated food product carriers 10 provided with a shucked oyster.

The cavities 22 are preferably accurately shaped to snugly receive the carriers 10 for facilitated packaging and storage.

As further shown in FIGS. 8–10, the tray may be provided with a central well 23. A removable cover 24 may be placed across the well, as shown in FIG. 10. Illustratively, condiments and sauces may be provided in the well, as desired.

The entire tray with the food products carried thereon, may be enclosed in an outer wrap, such as a 0.002" thick FDA-approved plastic film. The wrapping may be effected under vacuum and the film suitably heat sealed. The wrapped tray may then be quick frozen for suitable shipment or storage, as desired. The stored tray may be defrosted suitably when desired, and utilized in serving the plurality of shucked oysters to the consumer, with the tray then serving as an individual serving plate.

Alternatively, the individual simulated oyster on the half shell foodstuffs may be removed from the tray and placed on a conventional bed of ice for consumption of the oysters therefrom by the diner.

In one modified form of the invention, the tray is provided with the simulated food product carrier means as an integral part thereof. Thus, as seen in FIGS. 11–13, the plurality of individual food product carriers are formed in the tray itself. The individual carriers are not separated from the tray, but rather, the shucked oysters are placed individually in each of the upwardly opening cavities 25 of the tray 26. Thus, the tray 26 simulates a plurality of oyster shells permanently retained on the tray, with the consumer merely removing the shucked oyster from each of the cavities in turn.

As illustrated in FIG. 12, the tray 26 may have the individual food product carriers printed thereon in a manner similar to the printing of the carriers 10 illustrated in FIGS. 1–4. Thus, the representation 27 of the upper surface of the shell is printed on the underside of the clear plastic tray top wall 28, an opaque layer 29 is provided on the underside 30 of the upper representation 27, a representation 31 of the lower surface of the oyster shell is provided on the under surface 32 of the opaque layer 29, and a lowermost protective coating 33 provided on the under surface 34 of the representation 31.

The tray 26 is thusly formed in substantially the same manner as the individual carriers 10, except that the shell representations of the tray 26 are not separated therefrom.

As discussed briefly above, certain foodstuffs are preferably served heated rather than cold. Thus, illustratively, Oysters Rockefeller, which may be served on the oyster half shells, are served hot. The invention comprehends the formation of the simulated food product carrier from suitable material permitting the heating thereof for such purposes.

More specifically, as illustrated in FIGS. 5–7, a further modified form of simulated food product carrier generally designated 35, illustratively comprises a simulated oyster half shell wherein an upper film 36 is formed of clear polycarbonate and a lower film 37 is formed similarly of clear polycarbonate. Laminated between the films 36 and 37 is a sheet of opaque white, crystallizable polyethylene-terephthalate generally designated 38. The upper representation 39 is printed on the upper surface of the sheet 38, and the lower representation 40 is printed on the lower surface thereof.

The printing is preferably formed of nontoxic inks. Each of the sheets 36, 37, and 38 is capable of being heated to a relatively high temperature, such as 350° F. without substantial degradation thereof and, thus, the resultant food product carrier 35 may be used for both heating and serving of the food product at elevated temperatures.

The invention further comprehends that a tray, such as tray 41 illustrated in FIGS. 15–16, be formed of such high temperature resistant synthetic resins, whereby the entire tray, with the foodstuffs carried in the individual recesses thereof, be heated to serving temperatures without degradation thereof. Thus, as seen in FIG. 15, tray 41 may be formed of a similar lamination of an upper polycarbonate film 42, a lower polycarbonate film 43, and an intermediate, crystallizable polyethylene terephthalate sheet 44, with the upper surface representation 45 being provided on the upper surface of the sheet 44, and the lower representation 46 being provided on the lower surface of the sheet 44. Thus, tray 41 is similar to tray 26 in the provision of the simulated food product carriers integrally therein.

Alternatively, the high temperature resistant tray may be formed of a polycarbonate sheet in a manner similar to the forming of the tray 21 of FIGS. 8–10 and the individual simulated food product carriers 35 with the food products carried therein placed in the recesses of the nonprinted tray similarly as discussed relative to tray 21 above. Thus, the recesses of the tray may be accurately conformed to the configuration of the individual food product carriers 35, permitting facilitated packaging and storage.

Where individual food product carriers are placed in nonprinted trays, the trays may be clear, opaque, or colored, as desired.

In the high temperature carriers and trays, the polycarbonate film or sheet may have a thickness of approximately 0.005" and the crystallizable polyester sheet may have a thickness of approximately 0.020", in a preferred construction.

The printing of the upper and lower surfaces of the simulated carrier may be effected on the lower surface of the upper polycarbonate sheet and the upper surface of the lower polycarbonate sheet, respectively, in lieu of the provision thereof on the upper and lower surfaces of the intermediate polyester sheet, within the broad scope of the invention.

The laminate of the polycarbonate and polyester sheets is heated and vacuum-formed in a similar manner to the polyester sheet forming as described relative to carrier 10. As will be obvious to those skilled in the art, other modifications of the broad technique discussed above may be utilized within the scope of the invention. Thus, where it is desired to provide only a representation of the upper surface of the food carrier, this may be applied to the underside of the nontoxic upper synthetic resin sheet. Similarly, where an opaque printing is utilized, the representation of the lower surface may be applied directly to the undersurface of the upper representation.

Further, as will be obvious to those skilled in the art, the lower protective layer may be eliminated where desired, within the broad scope of the invention.

The invention is advantageously adapted for providing the food product carriers in the form of oyster half shells. The carriers have been found to provide an extremely faithful reproduction of the oyster half shell, and because of the facilitated packaging, storage, and preparation for serving permitted by the use of the invention, a substantial improvement in the provision of such foodstuffs is provided thereby.

The foregoing disclosure of specific embodiments is illustrative of the broad inventive concepts comprehended by the invention.

We claim:

1. A simulated food product carrier comprising:

a transparent wall element formed of a synthetic resin adapted to support edible foodstuffs without adverse physiological effect on one eating such supported foodstuffs, said wall element defining a rear surface;

a first representation of a front surface of a food product carrier on said rear surface to be viewable through said wall element; and a second representation of a rear surface of said food product carrier underlying said first representation to be viewable from rearwardly of said wall element.

2. The simulated food product carrier of claim 1 wherein said food product carrier comprises a simulated oyster shell.

3. The simulated food product carrier of claim 1 wherein an opaque layer is disposed between said representations.

4. The simulated food product carrier of claim 1 wherein said wall element is formed of a synthetic resin capable of storage at subfreezing temperatures.

5. The simulated food product carrier of claim 1 wherein said wall element is formed of a synthetic resin capable of being heated to over 300° F. without deformation thereof.

6. The simulated food product carrier of claim 1 wherein said wall element is formed to have a preselected three-dimensional configuration.

7. The simulated food product carrier of claim 1 wherein said wall element comprises a support defining a plurality of portions each defining an individual said simulated food product carrier.

8. The simulated food product carrier of claim 1 wherein a second transparent wall element is provided underlying said first representation and said second representation is provided on the upper surface of said second wall element.

9. The simulated food product carrier of claim 1 wherein said synthetic resin comprises polyethylene-terephthalate copolymer.

10. The simulated food product carrier of claim 1 wherein a protective coating is provided on said second representation.

11. A simulated food product carrier comprising:

a transparent first wall element formed of a synthetic resin adapted to support edible foodstuffs without adverse physiological effect on one eating such supported foodstuffs, said wall element defining a rear surface;

a first representation of a front surface of a food product carrier on said rear surface to be viewable through said first wall element;

an opaque second wall element underlying said representation;

a transparent third wall element formed of a synthetic resin and defining a front surface underlying said second wall element; and a second representation of a rear surface of said food product carrier on said front surface to be viewable through said third wall element, said wall elements being facially laminated together.

12. The simulated food product carrier of claim 11 wherein said wall elements are formed of synthetic resin capable of being heated to over 300° F. without deformation thereof.

13. The simulated food product carrier of claim 11 wherein said first and third wall elements are formed of polyethylene-terephthalate copolymer.

14. The simulated food product carrier of claim 11 wherein said first and third wall elements are formed of crystalline polyethylene-terephthalate copolymer.

15. The simulated food product carrier of claim 11 wherein said second wall element is formed of a carbamide synthetic resin.

16. The simulated food product carrier of claim 11 wherein said wall element comprises a support defining a plurality of portions each defining an individual said simulated food product carrier.

17. The simulated food product carrier of claim 11 wherein said edible foodstuff comprises a foodstuff required to be heated to a preselected elevated temperature before consumption.

18. The simulated food product carrier of claim 11 wherein said wall elements are formed of synthetic resin capable of being stored at temperatures below 32° F. without deformation thereof.

19. The simulated food product carrier of claim 11 wherein said foodstuff comprises a prepared foodstuff adapted to be stored at a temperature below 32° F. and requiring heating thereof to a temperature over 300° F. prior to consumption thereof.

20. A simulated food product carrier comprising:

a transparent first wall element formed of a synthetic resin adapted to support edible foodstuffs without adverse physiological effect on one eating such supported foodstuffs, said wall element defining a rear surface;

a first representation of a front surface of a food product carrier on said rear surface to be viewable through said first wall element;

a transparent second wall element having a front surface facially juxtaposed to said rear surface of said first wall element; and a second representation of a rear surface of said food product carrier on said front surface of the second wall element to be viewable through said second wall element.

21. The simulated food product carrier of claim 20 wherein said carrier is formed to have a preselected three-dimensional configuration.

22. The simulated food product carrier of claim 20 wherein said carrier is formed to have a preselected three-dimensional configuration defining an upwardly opening cavity for carrying the foodstuff.

23. The simulated food product carrier of claim 20 wherein means are provided for precluding viewability of said second representation through said first wall element, and precluding viewability of said first representation through said second wall element.

24. A simulated food product carrier comprising:

a transparent wall element formed of a synthetic resin adapted to support edible foodstuffs without adverse physiological effect on one eating such supported foodstuffs, said wall element defining a tray having a rear surface; and a plurality of first representations of a front surface of a food product on said rear surface to be viewable through said wall element, said wall element being formed to define three-dimensional food carrier configurations at each of said representations on the tray.

25. The simulated food product carrier of claim 24 wherein a corresponding plurality of second representations of a rear surface of said food product carrier is provided underlying and aligned with said first representations.

26. The simulated food product carrier of claim 24 wherein three-dimensional food carrier configurations define upwardly opening cavities in said tray.

27. The simulated food product carrier of claim 24 wherein a protective layer is provided on the undersurface of said first representation.

28. A multilayer simulated food product carrier comprising:

a transparent outer layer formed of a synthetic resin adapted to support edible foodstuffs without adverse physiological effect on one eating such supported foodstuffs, said outer layer defining a rear surface;

a first representation of a front surface of a food product carrier at said rear surface to be viewable through said wall element; and a second representation of a rear surface of said food product carrier underlying said first representation to be viewable from rearwardly of said carrier.

29. The multilayer simulated food product carrier of claim 28 wherein said carrier includes an opaque layer on which at least one of said representations is carried.

30. The multilayer simulated food product carrier of claim 28 wherein said carrier includes a transparent inner layer underlying said second representation.

31. A simulated food product carrier comprising:

wall means for supporting in an upwardly opening recess an edible portion of a foodstuff upon removal of the edible portion from a cover portion thereof; and simulation means on the wall means for simulating the cover portion of the foodstuff, and simulation means underlying said wall means adjacent said recess, said wall means further comprising means for permitting viewing of said simulation means through said recess.

* * * * *